US007875819B2

(12) United States Patent
Izumi

(10) Patent No.: US 7,875,819 B2
(45) Date of Patent: Jan. 25, 2011

(54) PANEL OPERATOR STRUCTURE FOR ELECTRONIC EQUIPMENT

(75) Inventor: Ryuichi Izumi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 14 days.

(21) Appl. No.: 11/952,972

(22) Filed: Dec. 7, 2007

(65) Prior Publication Data

US 2008/0173528 A1 Jul. 24, 2008

(30) Foreign Application Priority Data

Dec. 20, 2006 (JP) ..... 2006-342772

(51) Int. Cl.
*H01H 9/00* (2006.01)

(52) U.S. Cl. ..... 200/293; 200/345

(58) Field of Classification Search ..... 200/5 A, 200/310–314, 341–345, 293, 296
See application file for complete search history.

(56) References Cited

U.S. PATENT DOCUMENTS 4,742,198 A * 5/1988 Martin et al. ..... 200/296
6,198,057 B1 * 3/2001 Sato et al. ..... 200/19.18
7,423,886 B2 * 9/2008 Nishimoto et al. ..... 361/807
2004/0003986 A1 1/2004 Ito et al.

FOREIGN PATENT DOCUMENTS

DE 29 33 150 A1 2/1981
JP 04-259716 A 9/1992
JP 6-267373 9/1994
JP 2003-257283 A 9/2003

OTHER PUBLICATIONS

European Search Report mailed Nov. 6, 2009, for EP Application No. 07122456.2, seven pages.

* cited by examiner

*Primary Examiner*—Renee S Luebke
*Assistant Examiner*—Lisa Klaus
(74) *Attorney, Agent, or Firm*—Morrison & Foerster LLP

(57) ABSTRACT

A panel operator structure having operator units respectively disposed in position relative to operator unit insertion holes, thereby preventing key tops of the operator units from being in contact with the insertion holes. Switches are provided on an upper surface of a base plate and operation unit insertion holes are formed in an operation panel made of metal. Each operator unit includes a key top connected for vertical pivot motion to a casing via a hinge, and frame portions continuously formed together in an upper part of wall portions. The key top is disposed inside the frame portions with a gap therebetween. The frame portions fitted in the insertion hole restrict a horizontal positional motion of the operator unit relative to the operator insertion hole.

7 Claims, 7 Drawing Sheets

*FIG. 6* *(PRIOR ART)*
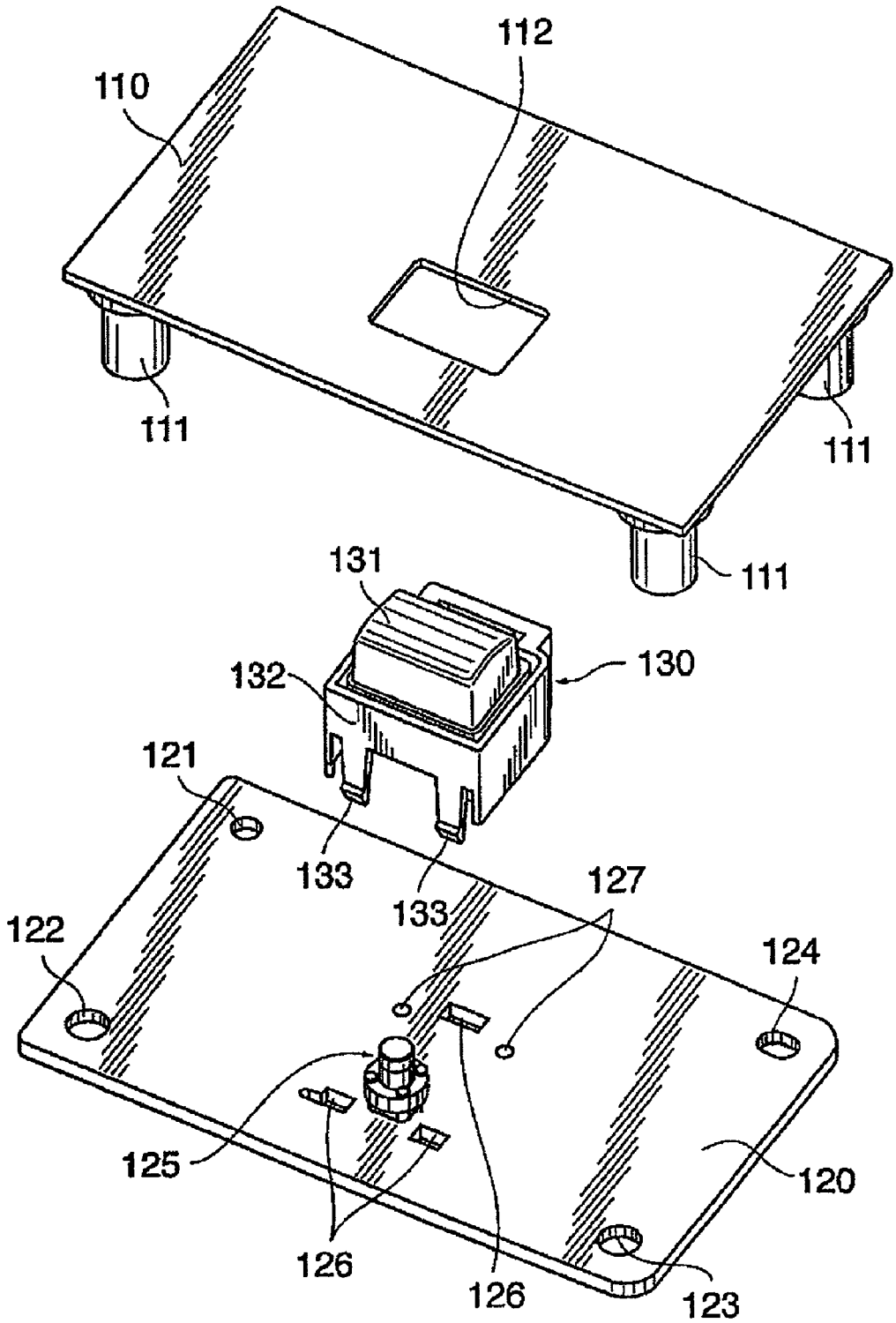

PANEL OPERATOR STRUCTURE FOR ELECTRONIC EQUIPMENT

BACKGROUND OF THE INVENTION

1. Field of the Invention

The present invention relates to a panel operator structure for electronic equipment such as sound equipment.

2. Description of the Related Art

Conventionally, some electronic equipment such as sound equipment includes an operation panel provided with a number of operator units. An operation panel of this type has a base plate thereof mounted with various switches that are each adapted to be turned on/off for function settings of the electronic equipment when a corresponding one of the operator units is operated.

FIG. 6 is an exploded schematic view showing an example of a prior art panel operator structure for electronic equipment, and FIG. 7 is a vertical section view of an operator unit of the prior art panel operator structure.

As shown in FIGS. 6 and 7, the panel operator structure includes a number of operator units (only one of which is shown by reference numeral 130 for simplified illustration) fixed on a base plate 120 and an operation panel 110 disposed in an overlapping relation and parallel with the base plate 120.

The base plate 120 has its four corners where there are formed an alignment hole 121, an elongated hole 124, and unloaded holes 122 and 123, which are used for panel mounting. Furthermore, three operator unit mounting holes 126 and two operator unit locating holes 127 are formed in the base plate 120, and switches (only one of which is shown at 125) are disposed on the base plate 120.

As shown in FIG. 7, the operator unit 130 includes a casing 132 to which a key top 131 as a depression-operated portion is connected via a hinge 135. An actuator 136 is formed integrally with a lower portion, as seen in FIG. 7, of the key top 131. The key top 131 is, when depressed or released, pivoted relative to the casing 132 in the vertical direction in FIG. 7. The switch 125 is turned on when depressed by the actuator 136.

The operator unit 130 is formed with three mounting pawls 133 and two locating pins 134 and fixed in position to the base plate 120 by the pawls 133 and the locating pins 134 inserted into the operator unit mounting holes 126 and the operator unit locating holes 127 of the base plate 120 for engagement therewith.

The operation panel 110 has its four corners formed with studs 111 in each of which a self-tapping pilot hole, not shown, is formed. To fix the operation panel 110 to the base plate 120, screws 128 are threadedly engaged with the self-tapping pilot holes of the studs 111 from the rear side of the base plate 120, with the studs 111 of the operation panel 110 aligned with the alignment hole 121, the elongated hole 124, and the unloaded holes 122, 123 and abutted against the base plate 120 on which the operator unit 130 has been mounted.

The operation panel 110 is formed with operator unit insertion holes 112 into which the operator units 130 are inserted. In a state where the operation panel 110 is fixed to the base plate 120, the key top 131 of each operator unit 130 is disposed within the insertion hole 112 with a clearance therebetween, as shown in FIG. 7. Provided that the operator unit 130 is disposed in position within the insertion hole 112, the key top 131 is kept out of contact with the insertion hole 112 when depressed or released.

In the prior art panel operator structure shown in FIGS. 6 and 7, the horizontal positional relation between the operation panel 110 and the base plate 120 is determined by the positional relation between the alignment hole 121 and a corresponding one of the pilot holes of the studs 111.

In the case of the operation panel 110 made of metal, the studs 111 are ordinarily welded or the like to the operation panel 110, and weld positions of the studs 111 can vary. In addition to a variation in the weld positions of the studs 111, there can be variations in shape of the studs 111 and position and shape of the pilot holes, resulting in a deviation in the positions of the studs 111 on the operation panel 110, which causes a deviation in the positional relation between the operation panel 110 and the base plate 120.

The horizontal positional relation between the operator units 130 and the operator unit insertion holes 112 of the operation panel 110 is affected not only by the above-described positional deviation between the operation panel 110 and the base plate 120, but also by the mounting accuracy of the operator units 130 on the base plate 120 since, as described above, the operator units 130 are fixed on the base plate 120. Furthermore, the positional relation between the operator units 130 and the insertion holes 112 is affected by the accuracy of formation of the insertion holes 112 in the operation panel 110.

Thus, a proper positional relation between the operator units 130 and the operator unit insertion holes 112 cannot sometimes be attained. In that case, the clearance between the insertion hole 112 and the key top 131 increases on one side of the key top, but decreases on the other side thereof. As a result, the key top 131 can be in contact with the insertion hole 112 when depressed or released. Such contact can result in operation failure, degraded operation feeling or the like.

For EMI countermeasure, rigidity maintenance, reduction in die cost or the like, a large-sized mixer apparatus in particular is often demanded to be made of metal (a steel plate or the like), not of resin. Moreover, such a mixer apparatus or the like is provided with a number of operator units 130. Therefore, the operation panel 110 becomes large in size, and a number of operator unit insertion holes 112 must be formed. The accuracy of forming the insertion holes 112 in the operation panel 110 is liable to be worsened. As a result, it is further difficult to attain a proper positional relation between the operator units 130 and the operator unit insertion holes 112 and between the operator panel 110 and a base plate 120.

Conventionally, therefore, the operation panel and the base plate formed with no locating holes are sometimes positioned by a personnel based on a visual checking to have a proper positional relation to each other. Then, the operation panel is fixed to the base plate by the personnel. However, such work is cumbersome.

Pattern wiring inhibition regions where formation of wiring patterns is inhibited are provided in the vicinity of operator unit mounting holes formed in the base plate. Thus, the greater the number of the operator units that must be provided, the much worsened the efficiency of pattern wiring will be.

Meanwhile, in the case of an operation panel made of resin as disclosed in Japanese Laid-open Patent Publication No. 06-267373, protrusions or other mounting portions can be formed on the operation panel, whereby operator units can be fixed to the operation panel.

On the other hand, in a case where such mounting portions are provided by welding or the like to an operation panel made of metal, the accuracy of providing the mounting portions becomes low, and therefore, a proper clearance cannot sometimes be provided between operator unit insertion holes and key tops, which poses a problem.

SUMMARY OF THE INVENTION

The present invention provides a panel operator structure for electronic equipment, in which a key top of each operator unit is prevented from being in contact with a corresponding one of operator unit insertion holes.

According to the present invention, there is provided a panel operator structure for electronic equipment, comprising a plurality of operator units, a base plate, an operation panel formed with fitting holes to each of which a corresponding one of the plurality of operator units is fitted, the operation panel being disposed in parallel to the base plate, and switches each having a driven portion, the switches being disposed on a side of the base plate close to the operation panel so as to correspond to the plurality of operator units, respectively, wherein each of the plurality of operator units includes a casing, a key top adapted to be pivoted relative to the casing in a direction not parallel to the base plate when subjected to a depression/release operation, and an actuator adapted to be moved in unison with the key top to depress and drive the driven portion of a corresponding one of the switches, and wherein the casing of each of the plurality of operator units is fixedly provided with a horizontal position restricting unit fitted in a corresponding one of the fitting holes formed in the operation panel, the horizontal position restricting unit being adapted to restrict a position of the operator unit in a direction parallel to the base plate.

With the panel operator structure of this invention, the operator units can individually be disposed in position relative to the operator unit insertion holes, making it possible to prevent the key top of each operator unit from being made in contact with the corresponding operator unit insertion hole when the key top is operated.

The key top of each of the plurality of operator units can be configured for pivotal motion in a corresponding one of the fitting holes in a position inside the horizontal position restricting unit.

In that case, the key top when operated can be prevented from being brought in contact with the operator insertion hole with reliability.

The casing of each of the plurality of operator units can be fixedly provided with a vertical position restricting unit, the vertical position restricting unit being interposed between the operation panel and the base plate and adapted to restrict a position of the operator unit in a direction perpendicular to the base plate.

In that case, the base plate is not required to be provided with operator unit mounting holes, making it possible to eliminate or reduce wiring pattern inhibition regions which are ordinarily provided around the mounting holes.

The key top of each of the plurality of operator units can be connected for pivotal motion to the casing via a hinge, and the hinge can be interposed between the operation panel and the base plate.

In that case, a gap with a constant width can be formed between the horizontal position restricting unit and the key top of each operator unit over the entire circumference of the key top, making it possible to improve external appearance.

The panel operator structure can include light emitting units disposed on a surface of the base plate on a side close to the operation panel so as to each correspond to an associated one of the plurality of operator units, and the key top of each of the plurality of operator units can be provided with a translucent portion through which light emitted from a corresponding one of the light emitting units passes, and the casing of each of the plurality of operator units can be made of an opaque material and can include wall portions thereof adapted to be in contact with a surface of the base plate on a side close to the operation panel and adapted to surround the light emitting unit and the switch.

In that case, light from the light emitting units can be prevented from leaking to the outside, making it possible for a depressed state of the operator units to be visually recognized by a user with reliability.

Further features of the present invention will become apparent from the following description of an exemplary embodiment with reference to the attached drawings.

BRIEF DESCRIPTION OF THE DRAWINGS

FIG. 6 is an exploded perspective view showing an example of a panel operator structure of prior art electronic equipment.

DETAILED DESCRIPTION OF THE PREFERRED EMBODIMENT

The present invention will now be described in detail below with reference to the drawings showing a preferred embodiment thereof.

Figure 1:
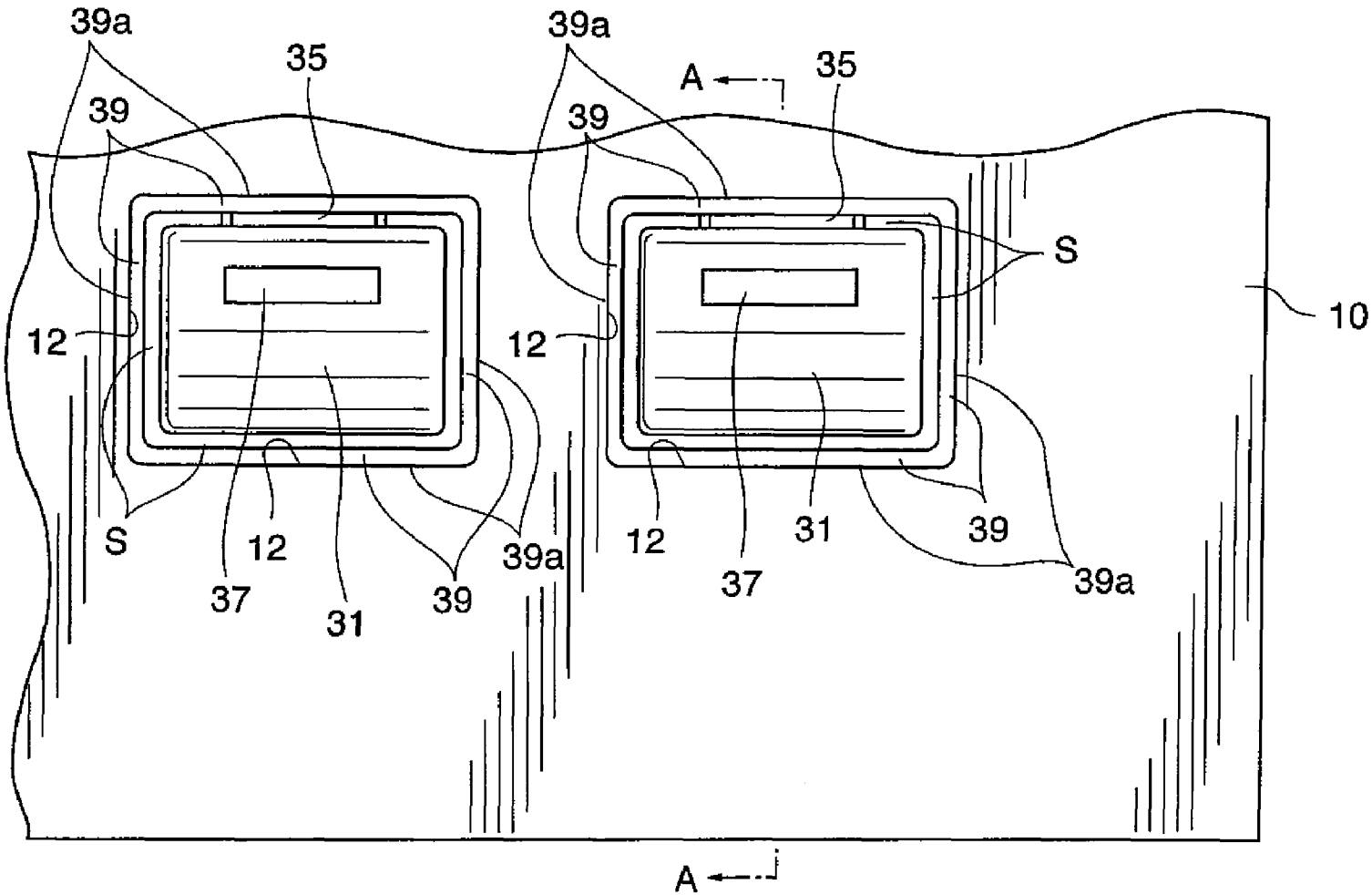
FIG. 1 is a fragmentary plan view of a panel operator structure according to one embodiment of this invention.

FIG. 1 shows in plan view a panel operator structure according to one embodiment of this invention.

This panel operator structure can be applied to various electronic equipment such as a mixer apparatus and other sound apparatuses.

Figure 2:
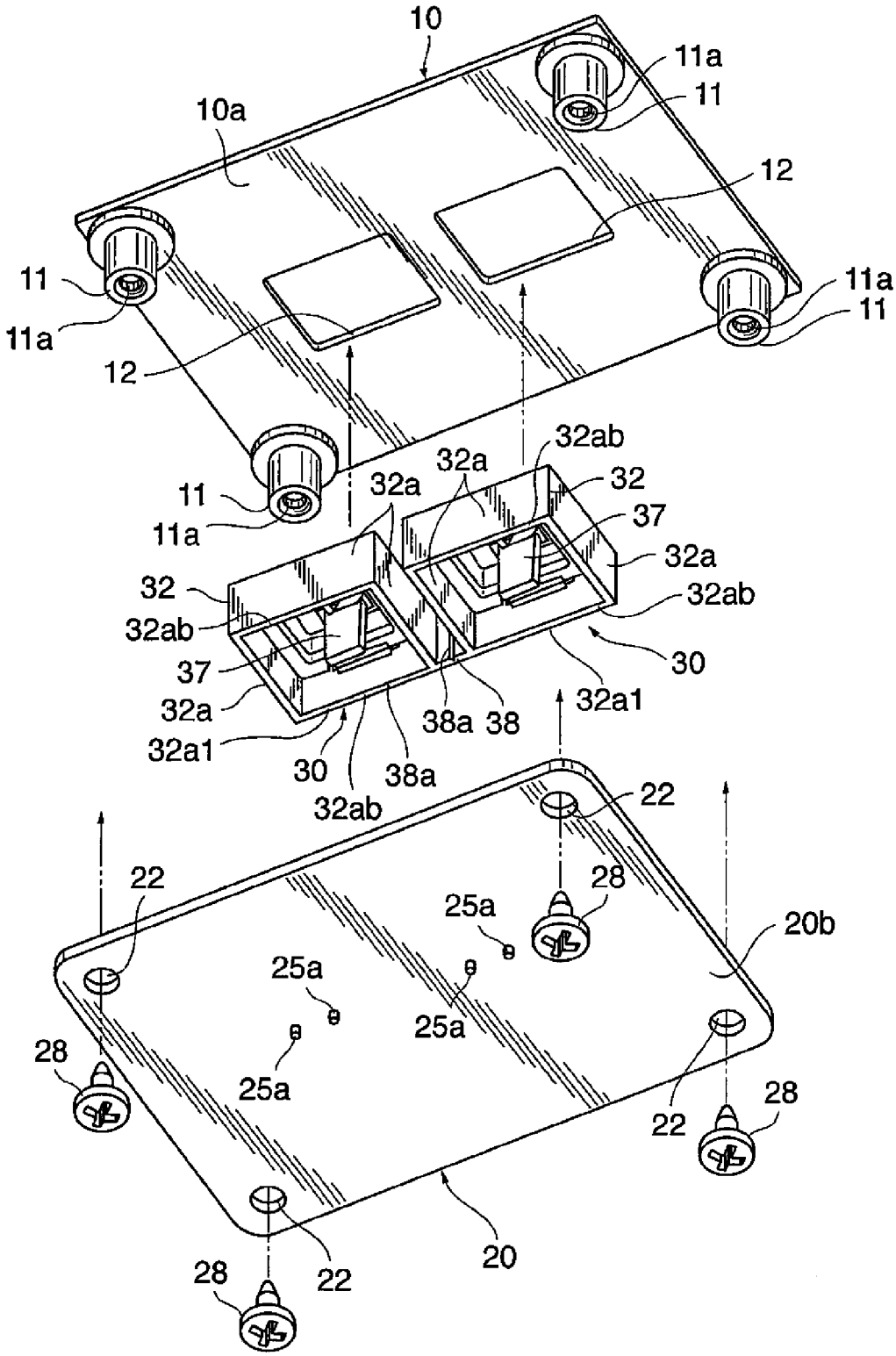
FIG. 2 is an exploded perspective view of the panel operator structure.

FIG. 2 shows the panel operator structure in an exploded schematic view. The panel operator structure includes a base plate 20 on which an operation panel 10 is disposed in a stacking fashion in parallel thereto. Operator units 30 are disposed between the base plate 20 and the operation panel 10. It should be noted that only the two operator units 30 are shown, but a greater number of operator units 30 can be provided. The two operator units 30 in FIG. 2 are disposed in a state in which they remain coupled to each other, but may be provided separately from each other as described later.

Figure 3:
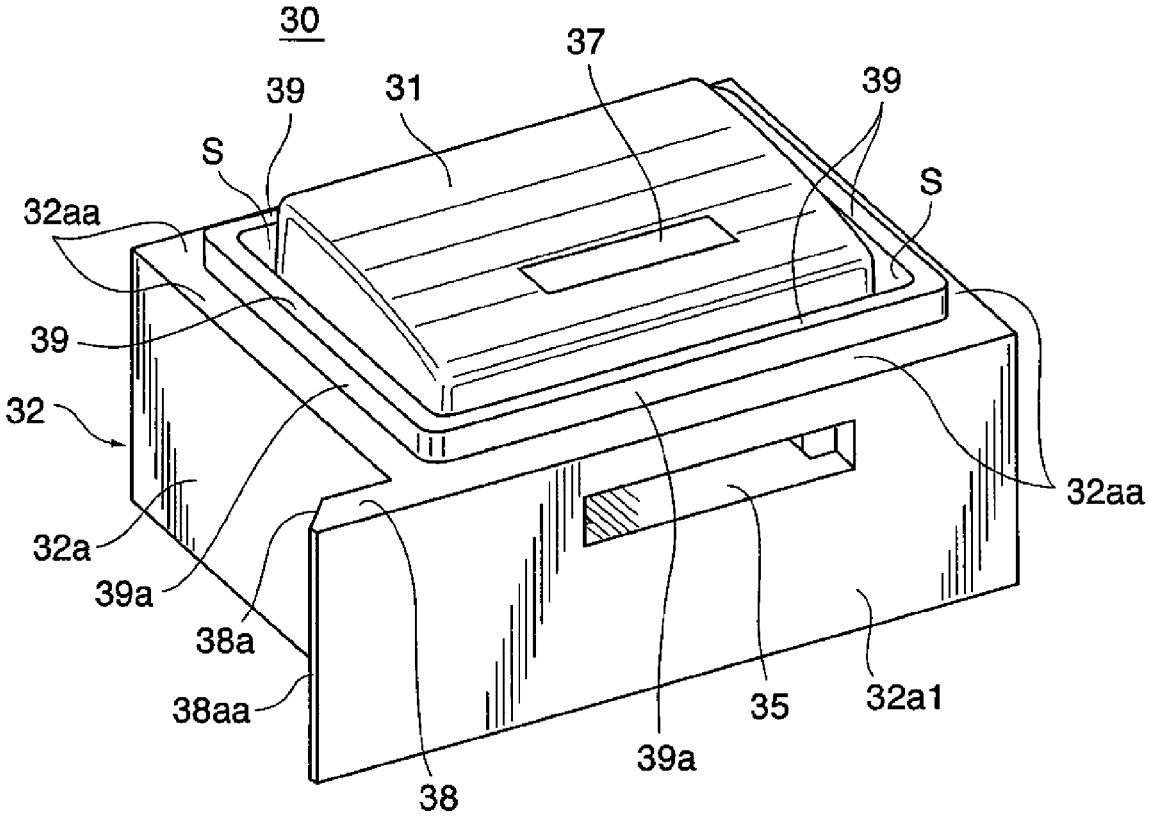
FIG. 3 is a perspective view of one operator unit of the panel operator structure.
Figure 4:
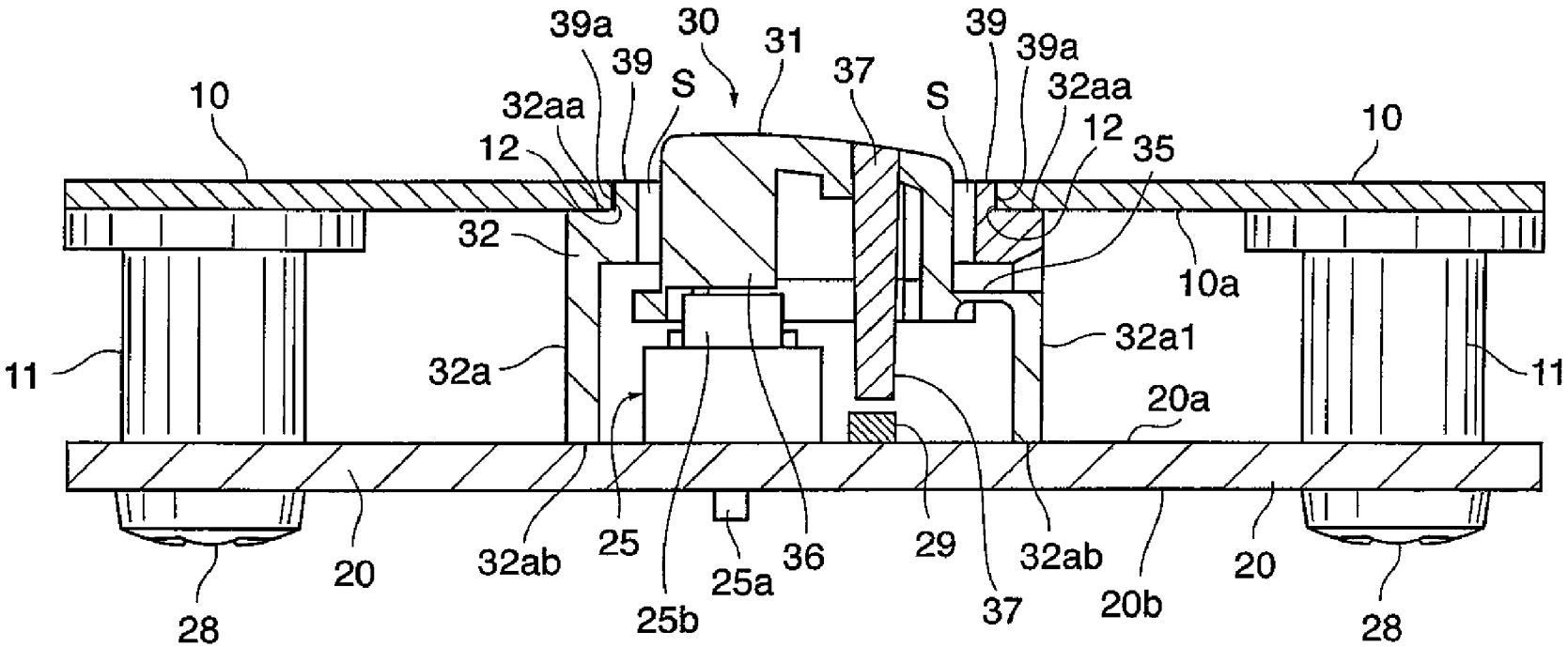
FIG. 4 is a section view taken along line A-A in FIG. 1.

FIG. 3 is a perspective view of one of the operator units 30, and FIG. 4 is a section view taken along line A-A in FIG. 1. For convenience of explanation, the side close to the operation panel 10 with respect to the base plate 20 is hereinafter referred to as the upper side. In other words, the upward and downward direction in the panel operator structure corresponds to the upward and downward direction in FIG. 4. To be noted, the operation panel is not necessarily positioned on the upper side of electronic equipment to which the panel operator structure is applied, but can be positioned on a lateral side or a lower side thereof.

As shown in FIG. 2, the base plate 20 has its four corners in each of which a panel mounting hole 22 is formed. Each panel mounting hole 22 may be an unloaded hole. As shown in FIG. 4, a plurality of pairs of a switch 25 and an LED 29, each pair corresponding to one of the operator units 30, are disposed on an upper surface 20*a* of the base plate 20. The switch 25 has a terminal 25*a* thereof exposed to a rear surface 20*b* of the base plate 20 (refer to FIGS. 2 and 4), and includes a driven portion 25*b* thereof adapted to be moved when depressed. The switches 25 and the LEDs 29 can be disposed in an arbitrary manner so long as they can be fixed to the base plate 20 before the operation panel 10 is mounted to the base plate 20.

The operation panel 10 is made of metal such as a steel plate. As shown in FIG. 2, studs 11 are provided by welding or the like to four corners of a rear surface 10*a* of the operation panel 10. Each stud 11 is formed with a self-tapping pilot hole 11*a*. The operation panel 10 is formed with operator unit insertion holes 12 through each of which a corresponding one of the operator units 30 can be inserted.

The two operator units 30 are made of resin and molded integrally with each other. As shown in FIG. 2, these operator units 30 are coupled together at their coupling portions 38 in each of which a thin thickness portion 38*a* is formed. The operator units 30 can be separated into individual pieces by cutting them at cut portions 38*aa* of the thin thickness portions 38*a*. One of the operator units 30 cut into two pieces at the cut portions 38*aa* is shown in FIG. 3.

In the above, a twin-type operator unit comprised of two operator units 30 has been described by way of example. A multi-coupled structure can be adopted, in which three or more operator units are coupled in line. Alternatively, another multi-coupled structure can be adopted, in which operator units 30 are coupled in a matrix fashion, i.e., coupled in the horizontal direction using the coupling portions 38 and in the vertical direction using coupling portions similar to the coupling portions 38. Each multi-coupled structure can be configured such that the operator units 30 are separated into groups each including a predetermined number of operator units or separated into individual pieces, and then mounted on the base plate 20 or the operation panel 10.

As shown in FIG. 4, each operator unit 30 includes a casing 32 to which a key top 31 subjected to a depression operation is connected via a hinge 35. The casing 32 has four wall portions 32*a* that are arranged in a rectangular shape as a whole as seen in plan view. The key top 31 is connected for vertical pivotal motion via the hinge 35 to the inner side of one of the wall portions 32*a* (hereinafter referred to as the wall portion 32*al*, where required). In a state where the operator units 30 and the operation panel 10 are assembled together, each hinge 35 is disposed between the base plate 20 and the operation panel 10 (refer to FIG. 4). Thus, the hinge 35 can only slightly be seen from above through a gap S between the key top 31 and frame portions 39 (described later), as shown in FIG. 1.

As shown in FIG. 4, the key top 31 of each operator unit 30 has a lower portion thereof integrally formed with an actuator 36. When subjected to a depression/release operation, the key top 31 is vertically pivoted relative to the casing 32 and the actuator 36 is vertically pivoted together with the key top 31. When the key top 31 is in non-depressed state, a lower end of the actuator 36 is positioned near a driven portion 25*b* of the switch 25. When the key top 31 is depressed, the driven portion 25*b* of the switch 25 is depressed by the actuator 36, and the switch 25 is turned on. The switch 25 is used, for example, for the setting of a predetermined function. The switch 25 must be configured to be driven by the actuator 36 so as to be turned on/off, for example, but is not limited in its construction and function to the illustrated one.

In the key top 31 of each operator unit 30, a translucent portion 37 is provided closer to the wall portion 32*a*1 than to the actuator 36. The translucent portion 37 is formed by a transparent resin. On the other hand, portions of the operator unit 30 other than the translucent portion 37 are formed by an opaque resin. Thus, the operator unit 30 is integrally molded using two-color molding in which the transparent resin and the opaque resin are used.

The translucent portion 37 has an upper end thereof disposed in flush with the upper surface of the key top 31 so as to be exposed to the outside (see, FIGS. 1 and 3). In a state that the operator units 30 are assembled between the operation panel 10 and the base plate 20, a lower end of the translucent portion 37 of each operator unit 30 is positioned near the LED 29. When the electronic equipment is in use, the LED 29 is always in a light emission state. Alternatively, the LED 29 can be made in a light emission/extinction state in response to the switch 25 being turned on/off upon depression/release of the key top 31. Light emitted from the LED 29 passes through the translucent portion 37 and is visually recognized by a user.

In the state that the operator units 30 are assembled between the operation panel 10 and the base plate 20, lower ends 32*ab* of the four wall portions 32*a* of each operator unit 30 are in abutment with the upper surface 20*a* of the base plate 20 so as to surround the switch 25 and the LED 29. Since the wall portions 32*a* are opaque, light emitted from the LED 29 is blocked by the wall portions 32*a* and prevented from leaking to the outside of the operator unit 30, but can be visually recognized only from the side of the upper end of the translucent portion 37 of the operator unit 30.

The four wall portions 32*a* have upper parts thereof each formed with a stepped portion. Specifically, the upper part of each wall portion 32*a* includes a ridge-like frame portion 39 located inside an upper end 32*aa* of the wall portion 32*a* and extending beyond the upper end 32*aa*. As shown in FIG. 1, the frame portions 39 are continuously connected together to describe a rectangular shape as seen in plan view, and the key top 31 is positioned inside the frame portions 39 with a gap S of a predetermined width therebetween.

In the state that the operator units 30 are assembled between the operation panel 10 and the base plate 20, the frame portions 39 of each operation unit 30 are fitted into a corresponding one of the operator unit insertion holes 12 formed in the operation panel 10. Specifically, outer side surfaces 39*a* of the frame portions 39 are engaged along the entire circumference thereof with the insertion hole 12. As a result, the position of the operator unit 30 relative to the operator unit insertion hole 12 as viewed in the horizontal direction (parallel to the operation panel 10 and the base plate 20) is restricted. Thus, the frame portions 39 (more specifically, the outer side surfaces 39*a* thereof) cooperate with the insertion hole 12 to function as a "horizontal position restricting unit" that restricts the position of the operator unit 30 in the horizontal direction.

Furthermore, the upper and lower ends 32*aa*, 32*ab* of the wall portions 32*a* of each operation unit 30 are in abutment with the rear surface 10*a* of the operation panel 10 and the upper surface 20*a* of the base plate 20, respectively. As a result, the vertical position of each operator unit 30 relative to the base plate 20 and the operation panel 10 is restricted. Thus, in the state where the operator units 30 are assembled between the operation panel 10 and the base plate 20 as shown in FIG. 4, the operator units 30 can be fixed in position, without the need of using additional fixing means such as fastening screws and the like.

Thus, the upper and lower ends 32*aa*, 32*ab* of the wall portions 32*a* of each operator unit 30 cooperate with the rear surface 10*a* of the operation panel 10 and the upper surface 20*a* of the base plate 20 to function as a "vertical position restricting unit" that restricts the position of the operator unit 30 in the vertical direction (normal to the base plate 20).

The operator units 30 and the operation panel 10 are assembled onto the base plate 20, as described below.

First, all the switches 25 and the LEDs 29 are fixedly disposed on the base plate 20. For easy understanding of the following description, the reader is requested to turn the sheet of FIG. 2 upside down. After the operation panel 10 is reversed, the operator units 30 are fitted into the operator unit insertion holes 12 from the rear surface 10*a* side of the operation panel 10. At this time, the upper ends 32*aa* of the wall portions 32*a* of each operator unit 30 are brought in abutment with the rear surface 10*a* of the operation panel 10, which facilitates the subsequent assembly operations since the operator units 30 can be kept unmoved even if the operation panel 10 is somewhat inclined.

Next, the base plate 20 is mounted on the operation panel 10 such that the upper surface 20*a* of the base plate 20 covers the rear surface 10*a* of the operational panel 10 and the panel mounting holes 22 are aligned with the pilot holes 11*a* formed in the studs 11. Subsequently, screws 28 are threadedly engaged with the pilot holes 11*a* of the studs 11 from the side of the rear surface 20*b* of the base plate 20, whereby the operation panel 10 is fixed to the base plate 20 in parallel therewith. At the same time, the lower ends 32*ab* of the four wall portions 32*a* of each operator unit 30 are brought in abutment with the upper surface 20*a* of the base plate 20 and surround the switch 25 and the LED 29 associated therewith.

The dimension between the upper and lower ends 32*aa*, 32*ab* of the wall portions 32*a* is set to a value that is equal to or slightly less than the length of the studs 11. Thus, the distance between the operation panel 10 and the base plate 20 is substantially determined by the length of the studs 11.

In the above-described arrangement, when the key top 31 of any of the operator units 30 is depressed or released, the key top 31 is vertically pivoted within the frame portions 39 of the operator unit, without being in contact with the operator unit insertion hole 12.

According to this embodiment, the position of each operator unit 30 in the direction parallel to the base plate 20 is restricted by the frame portions 39 of the operator unit 30 being fitted into the insertion hole 12 of the operation panel 10. Thus, the positional relation between the operator unit 30 and the insertion hole 12 is not affected by a deviation in relative position between the operation panel 10 and the base plate 20 and by the degree of positional accuracy of the insertion hole 12 formed in the operator panel 10. In particular, even if the operation panel 10 is made of metal and formed with a number of the insertion holes 12 whose positional accuracy is not quite high, a deviation of relative position between the operator units 30 (more specifically, the casing 32 thereof) and the insertion holes 12 is not caused.

Thus, a proper positional relation can be attained between each operator unit 30 and the corresponding operator unit insertion hole 12, making it possible to prevent the key top 31, when operated, from being brought in contact with the insertion hole 12. In addition, there is provided a gap S between the key top 31 and the corresponding frame portions 39 of each operation unit 30, which ensures that the key top 31 is prevented from being in contact with the insertion hole 12. As a result, operation failure, degraded operation feeling or the like can be suppressed from occurring due to contact between any of the key tops and the corresponding insertion hole. In particular, the operation of the key tops 31 is not affected, even if the operation panel 10 is made of metal and any of the insertion holes 12 has some burrs.

The operator units 30 assembled between the operation panel 10 and the base plate 20 are retained therebetween so as to be restricted in vertical position, making it unnecessary to provide the base plate 20 with holes and the like used for mounting the operator units 30, and therefore, pattern wiring inhibition regions which are ordinarily provided around the operator unit mounting holes can be reduced or eliminated and hence the efficiency of pattern wiring can be improved.

Since the hinge 35 of each operator unit 30 is located between the base plate 20 and the operation panel 10, the gap S with a constant width can be formed between the key top 31 and the frame portions 39 of the operator unit 30 over the entire circumference of the key top, making it possible to improve external appearance. In addition, the operator unit 30 can be formed into a thin-shape with ease, to thereby reduce the degree of projection of the operator unit from the operation panel 10. Although the key top 31 of this embodiment slightly projects from the operation panel 10, the key top 31 can be designed so as to be in flush with or to be located lower than the surface of the operation panel 10. Since the hinge 35 is disposed lower than the operation panel 10, the hinge 35 is not required to be extended from the upper end of the frame portion 39 associated therewith. As a result, the frame portions 39 of each operator unit 30 can be continuously formed over the entire circumference thereof without any disconnection and can be fitted at their entire circumference into the insertion hole 12, whereby the function of restricting the horizontal position of the operator unit 30 can be achieved satisfactorily.

Furthermore, the LED 29 of each operation unit 30 is completely covered by the wall portions 32*a* from four directions, and the wall portions 32*a* are made of opaque resin. As a result, light emitted from the LED 29 is prevented from leaking to the outside, and the depressed state of each operator unit 30 can be visually recognized with reliability based on light passing through the translucent portion 37 of the operator unit 30.

The key top 31 of each operator unit 30 of this embodiment is configured for pivotal motion in the direction perpendicular to the base plate 20, but this is not limitative. The present invention can be applied to any operator units 30 so long as they are configured to be pivoted relative to the base plate 20 in a direction other than the horizontal direction.

Figure 5A:
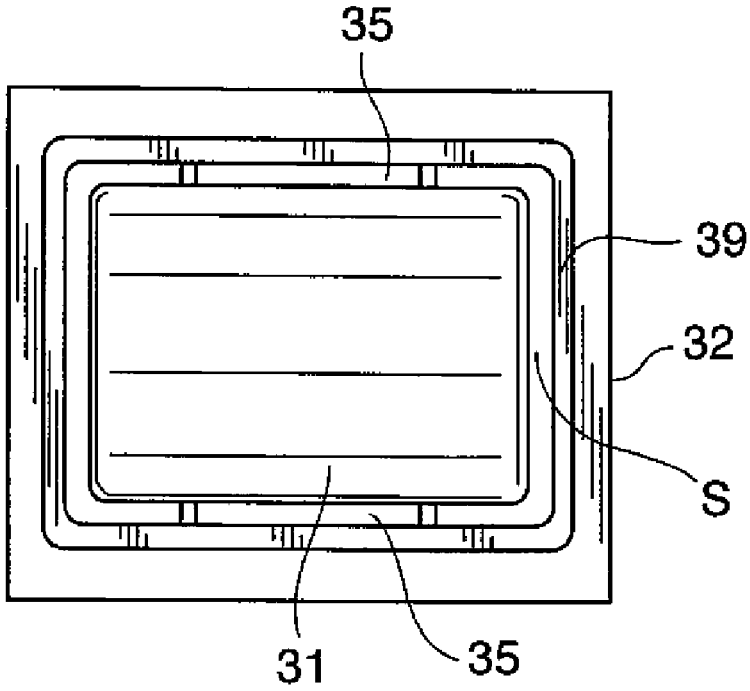
FIG. 5A is a plan view showing a modification of the operator unit.

As shown in FIG. 5A in which an operator unit according to a modification of the above-described embodiment is shown in plan view, each key top 31 can be configured for connection to the casing 32 via two hinges 35 between which the key top 31 is interposed for pivotal motion in the vertical direction parallel to the casing 32. Alternatively, the key top 31 can be connected to the casing 32 via three or more appropriately spaced hinges (not shown) or via a hinge (not shown) provided along the entire circumference of the key top 31.

The frame portions of each operator unit 30 of this embodiment are continuously connected together, without any disconnection, to extend along the entire circumference thereof. Since the frame portions are only required to restrict the horizontal position of the casing 32, there may be a disconnection between the frame portions 39. The frame portions may be formed into a shape other than a frame-like shape. Plural portions adapted to be engaged with the operator unit insertion hole 12 and functioning to restrict a motion of the casing 32 in four directions can be fixedly provided relative to the casing 32. The frame portions 39 can be formed into a circular or ellipsoid shape as well as a quadrangular or rectangular shape as viewed in plan. In the case of frame portions formed into a circular shape, it is enough to provide at least three spaced restriction portions in order to restrict the horizontal motion of the casing 32.

Figure 5B:
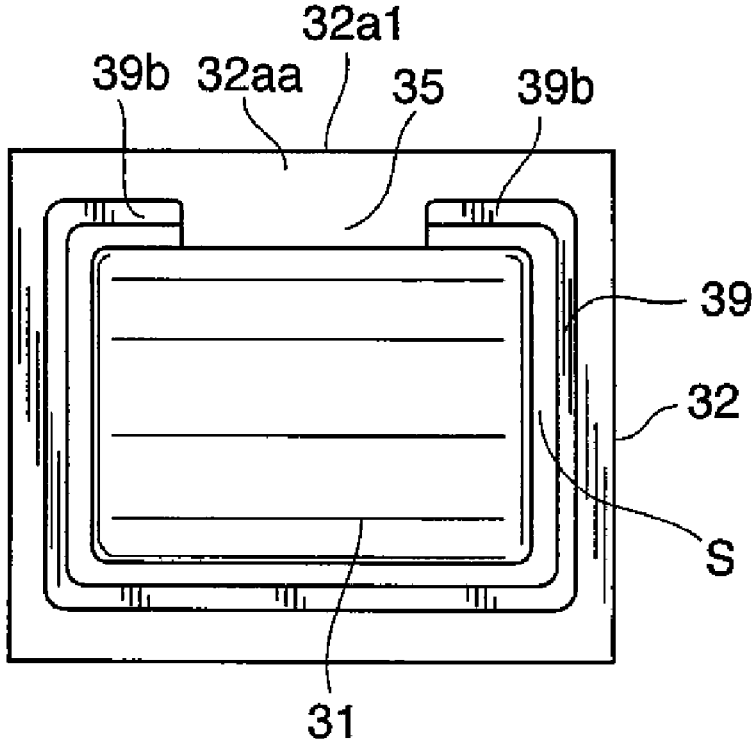
FIG. 5B is a plan view showing another modification of the operator unit.
Figure 7:
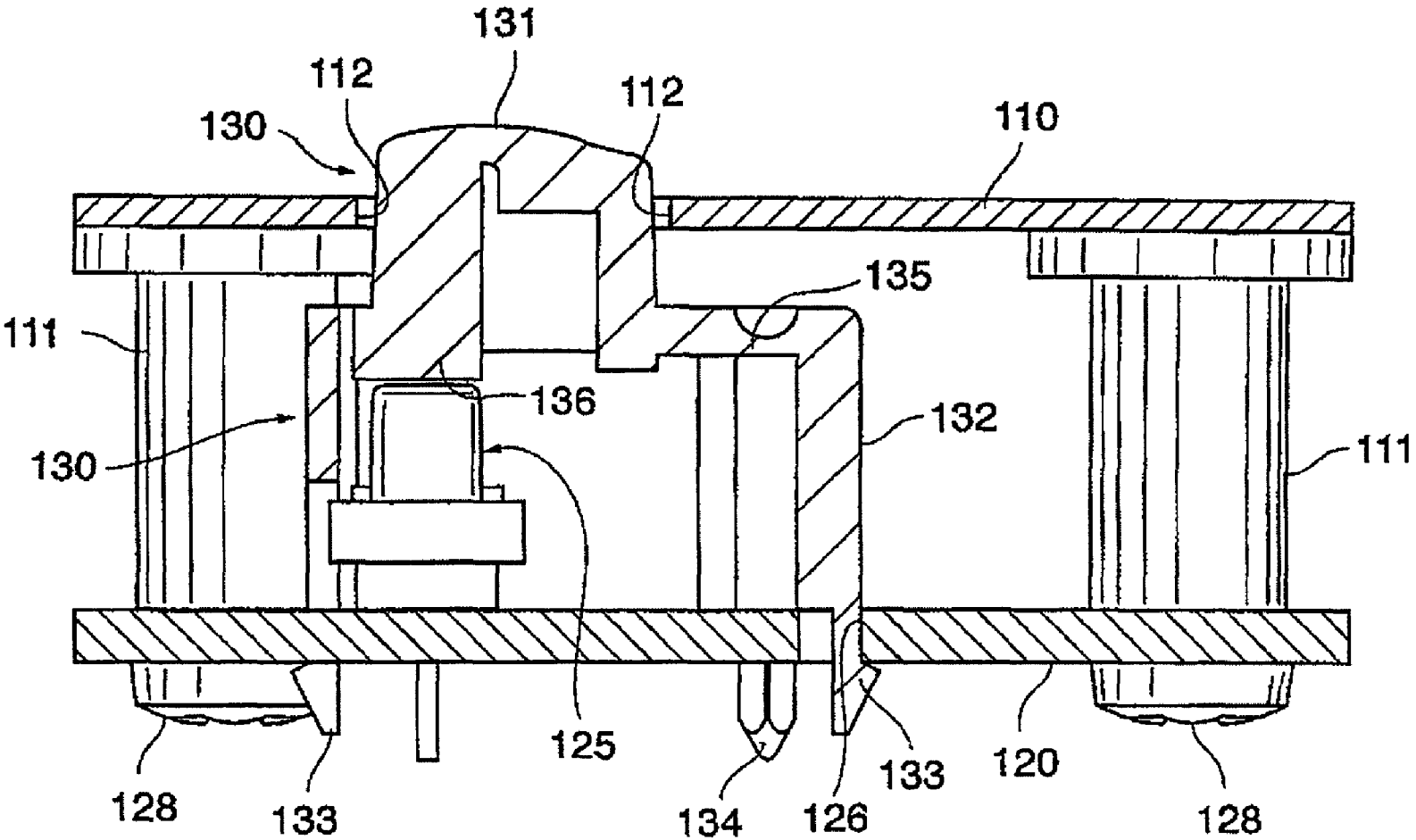
FIG. 7 (PRIOR ART)
FIG. 7 is a vertical section view of an operator unit of the prior art panel operator structure.

Although the advantage achieved by the gap S with a constant width formed over the entire circumstance of the key top 31 cannot be attained, an operator unit according to another modification shown in plan view in FIG. 5B can be adopted. In this operator unit, the hinge 35 is extended from the upper end 32*aa* of the wall portion 32*a*1 of the casing 32 and provided at a vertical position which is the same as or higher than that of the upper end 32*aa*. Although a disconnection is formed in the frame portions 39 due to the presence of the hinge 35, the positional motion of the casing 32 in four directions can be restricted without any trouble since frame portion parts 39*b* are provided even on the side of the wall portion 32*a*1.

It should be noted that the key top 31 of each operator unit 30 can be formed by elastomer in the above-described embodiment. In the arrangement shown in FIG. 5A where the key top 31 is vertically pivoted in parallel to the casing 32, both the key top 31 and the hinge 35 can be formed by elastomer. Even in such arrangements, there is no fear that the key top 31 is made in contact with the operator unit insertion hole 12, and therefore, the advantage of improving operation feeling can be attained with ease.

What is claimed is:

1. A panel operator structure for electronic equipment, comprising:

a plurality of operator units;

a base plate;

an operation panel formed with fitting holes to each of which a corresponding one of the plurality of operator units is fitted, said operation panel being disposed in parallel to said base plate; and switches each having a driven portion, said switches being disposed on a side of said base plate close to said operation panel so as to correspond to the plurality of operator units, respectively, wherein each of the plurality of operator units includes a casing having a frame portion with an outer side surface, a key top adapted to be pivoted relative to the casing in a direction not parallel to said base plate when subjected to a depression/release operation, and an actuator adapted to be moved in unison with the key top to depress and drive the driven portion of a corresponding one of the switches, wherein the outer side surface of the frame portion of one of the plurality of operator units and a portion of the operation panel defining the fitting holes to which the one of the plurality of operator units is fitted are engaged with each other and constitute a horizontal position restricting unit that is adapted to restrict a position of the operator unit in a direction parallel to said base plate, and wherein the frame portion of the one of the plurality of operator units is integrally formed with the casing of the one of the plurality of operator units.

2. The panel operator structure according to claim 1, wherein the key top of each of the plurality of operator units is configured for pivotal motion in a corresponding one of the fitting holes in a position inside the horizontal position restricting unit.

3. The panel operator structure according to claim 1, wherein the casing of each of the plurality of operator units is fixedly provided with a vertical position restricting unit, said vertical position restricting unit being interposed between said operation panel and said base plate and adapted to restrict a position of the operator unit in a direction perpendicular to said base plate.

4. The panel operator structure according to claim 1, wherein the key top of each of the plurality of operator units is connected for pivotal motion to the casing via a hinge, and the hinge is positioned between said operation panel and said base plate.

5. The panel operator structure according to claim 1, including:

light emitting units disposed on a surface of said base plate on a side close to said operation panel so as to each correspond to an associated one of the plurality of operator units, wherein the key top of each of the plurality of operator units is provided with a translucent portion through which light emitted from a corresponding one of the light emitting units passes, and wherein the casing of each of the plurality of operator units is made of an opaque material and includes wall portions thereof adapted to be in contact with a surface of said base plate on a side close to said operation panel and adapted to surround the light emitting unit and the switch.

6. The panel operator structure according to claim 1, wherein the casing, the key top, and the actuator constituting each of the operator units are made of resin integrally with one another, and each of the operator units is fixed in position with a lower end of the casing abutted against said base plate by fixing the base plate and the operation panel to each other using screws.

7. The panel operator structure according to claim 1, wherein the plurality of operator units of a multi-type, and two of the plurality of operator units are integrally coupled together through a coupling portion.

* * * * *